United States Patent [19]

Dudouyt

[11] Patent Number: 4,570,562

[45] Date of Patent: Feb. 18, 1986

[54] LIGHT SAILING VEHICLE WITH MOVABLY MOUNTED MAST

[76] Inventor: Jean-Paul Dudouyt, Les Ca elias, Place des Palmiers, 44500 La Baule Les Pins, France

[21] Appl. No.: 503,125

[22] Filed: Jun. 10, 1983

[30] Foreign Application Priority Data

Dec. 20, 1982 [FR] France ..... 82 21332

[51] Int. Cl.[4] ..... B63H 9/04

[52] U.S. Cl. ..... 114/39; 114/91; 114/102

[58] Field of Search ..... 114/39, 102, 90, 91; 200/1.11 A, 810

[56] References Cited

U.S. PATENT DOCUMENTS

| | | | |
|---|---|---|---|
| 8,164 | 6/1851 | Brown | 114/90 |
| 1,916,459 | 7/1933 | Blackman | 114/91 |
| 3,090,340 | 5/1963 | McCutchen et al. | 114/102 |
| 3,141,435 | 7/1964 | Moffitt, Jr. | 114/90 X |
| 3,370,560 | 2/1968 | Lucht | 114/39 |
| 4,249,276 | 2/1981 | Snyderman | 114/102 X |

FOREIGN PATENT DOCUMENTS

| | | | |
|---|---|---|---|
| 2059857 | 5/1971 | France | 114/91 |
| 2409184 | 6/1979 | France | 114/91 |

*Primary Examiner*—Sherman D. Basinger
*Attorney, Agent, or Firm*—Edwin E. Greigg

[57] ABSTRACT

The invention relates to light, sailing vehicles equipped with at least one sail fixed on a mast and attached to a boom. The mast is supported toward its middle part at the top of a two-legged support, in the form of an inverted V, and mounted rigidly on the frame of the vehicle, while the foot of the mast is mounted in such a manner as to be capable of sliding along a cross member substantially perpendicular to the plane of symmetry of said frame and shifted toward the front with respect to the transverse plane passing through the top of the two-legged support.

4 Claims, 5 Drawing Figures

LIGHT SAILING VEHICLE WITH MOVABLY MOUNTED MAST

FIELD OF THE INVENTION

The invention relates to wind-powered light vehicles which are used on land or at sea. More specifically, it relates to a mode of fixation of the mast which enables its base or foot to be displaced transversely at either side of the plane of symmetry of the vehicle. The invention is applicable to various types of light sailing vehicles (boats, sailing cars, sleds on runners or skis) on which the steering device or devices disposed at the rear, but it is particularly advantageous for multi-hull boats such as catamarans or trimarans.

OBJECT AND SUMMARY OF THE INVENTION

According to the invention, the mast of the sailing vehicle is articulated toward its middle at the top of a support, in the form of an inverted V mounted rigidly on the vehicle frame, while the foot of the mast is mounted such that it slides along a cross member which is substantially perpendicular to the plane of symmetry of the frame and is shifted toward the front with respect to the transverse plane passing through the top of the support.

This disposition enables the plane of the sail or sails to be inclined with respect to the frame, thereby facilitating certain maneuvers, as will be described in greater detail below.

In an advantageous manner, the point for securing the tack of the boom is carried by a roller or slide, which is capable of moving along a cross member parallel to that which supports the foot of the mast. The plane of the sail or sails may then be shifted either diagonally or parallel to itself.

The means for articulation of the mast on the support make it possible to attain the maximum mobility. It may be constitued as a simple ring traversed freely by the mast, or a mechanical joint generally of the swivel type, but in the latter case, the base of the mast must be constituted by a telescoping structure such as to enable it to extend in length whenever the foot of the mast is displaced laterally.

It is also possible to provide a displacement of the support parallel to the longitudinal axis of the vehicle in such a manner as to enable the rake of the mast to be modified.

An equivalent arrangement may be conceived of when the vehicle is rigged with a rigid or semi-rigid trapeze sail stretched between two yards. In that case, a support must be provided for each yard, which is then disposed in the manner to be described below for the mast of a standard set of sails. Finally, in the case of a rigid sail with a narrow profile, known as the "airplane wing" type, this rigid structure will be fixed solely on a universal joint disposed at the top of a central support.

The invention will be better understood by reading the following description of one embodiment of the invention as applied to a catamaran, taken in conjunction with the drawings.

BRIEF DESCRIPTION OF THE DRAWINGS

FIG. 4 is a side view of a modification of the device of FIGS. 1 and 2, and;

DESCRIPTION OF THE PREFERRED EMBODIMENT

Figure 1:
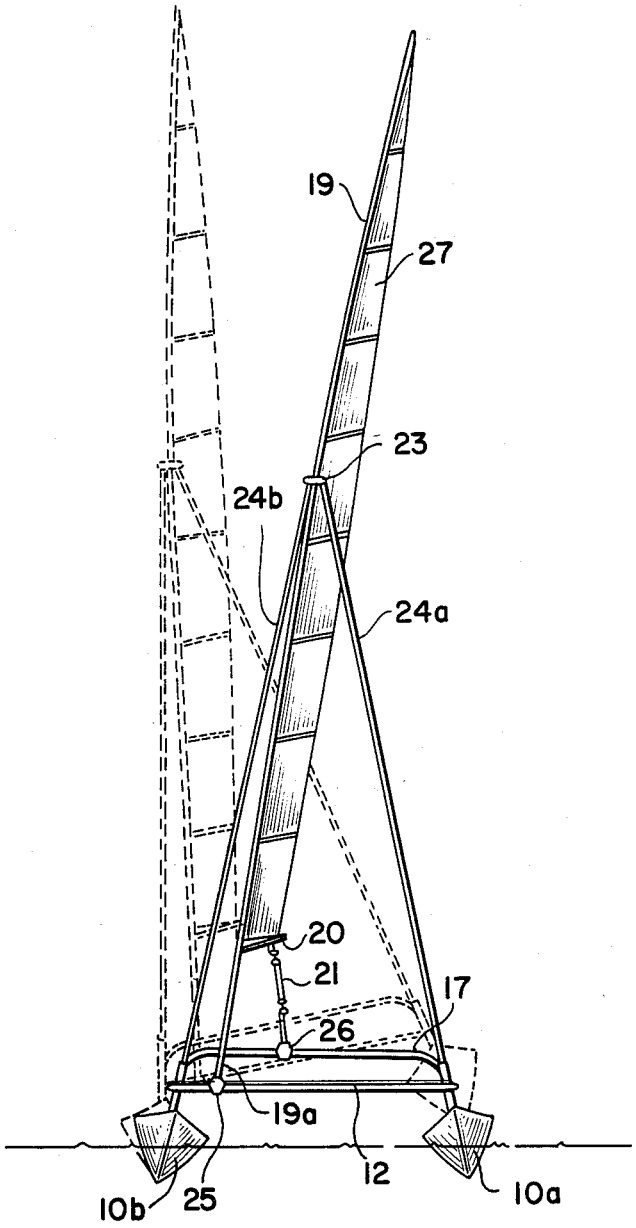

In the drawing, a catamaran is shown which in the standard fashion comprises two parallel and identical floats 10*a* and 10*b*, rigidly connected together and fixed in position relative to each other by a frame, which in this case is tubular. The frame comprises two longitudinal members 11*a* and 11*b* cross-braced by cross members 12, 13, 14, 15, 16. In the illustrated example, one of the cross members 16, located toward the rear, is reinforced by an upstanding hoop 17. The platform 18 intended for accommodating the user or users of the vehicle is disposed between the rear portions of the longitudinal members, located between the cross members 14 and 15. This platform 18 may be either somewhat flexible or rigid.

In this example the catamaran is equipped with a single sail 27 of triangular shape, which is fixed by any suitable known means on a mast 19 and attached at its bottom edge to a boom 20 which is capable of pivoting about the mast and which is connected to the frame by a tack 21 and a downhaul 22.

Figure 2:
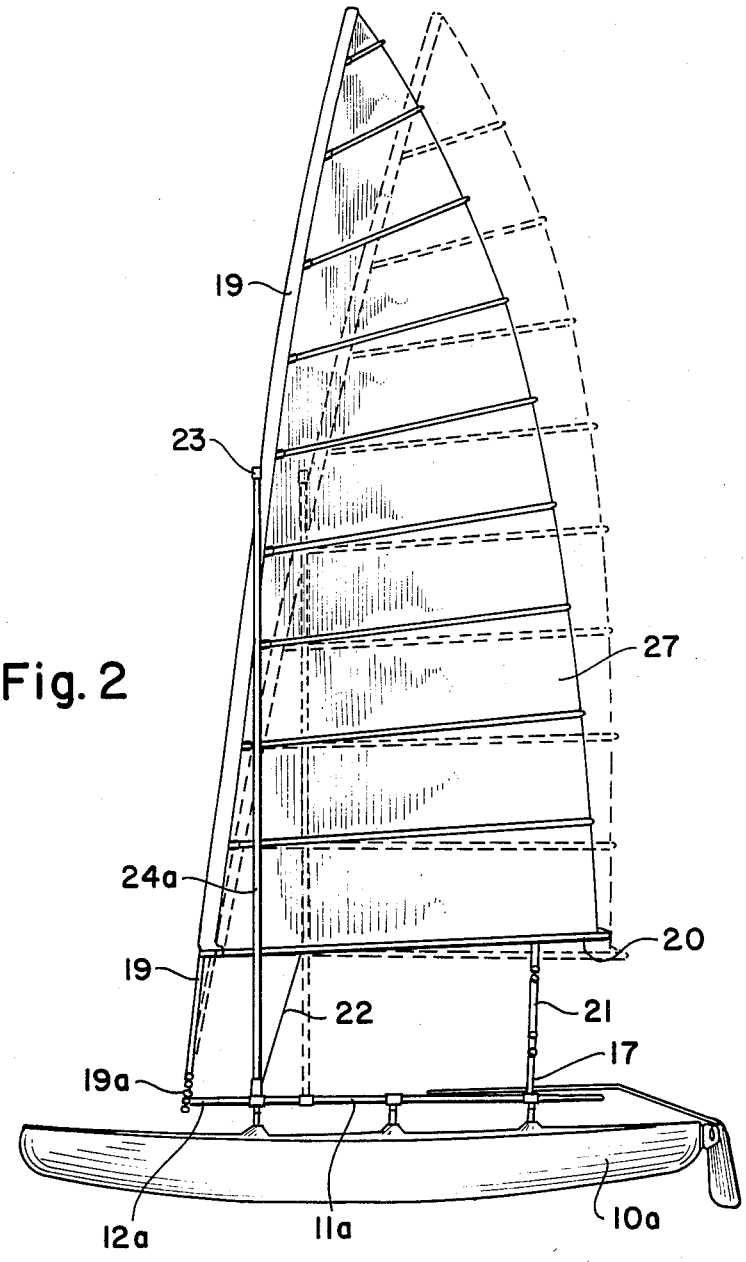
FIG. 2 is a side view of the catamaran of FIG. 1, showing in broken lines a different position of the sail attained by longitudinally displacing the two-footed support.
Figure 3:
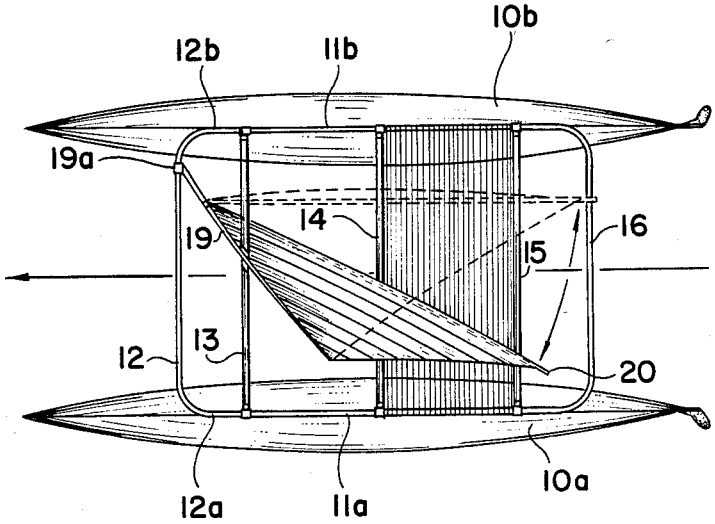
FIG. 3 is a view of the above showing in schematic fashion the movability of the plane of the sail.
Figure 4:
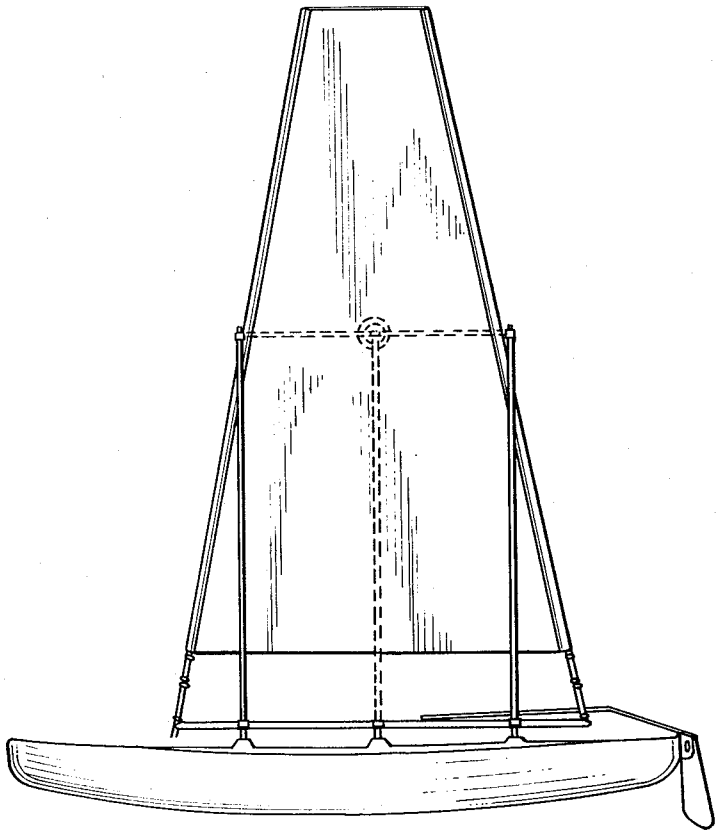
FIG. 4 is a front elevational view of a catamaran, showing the broken lines the position assumed when one of the floats, pontoons, or hulls is out of the water.
Figure 5:
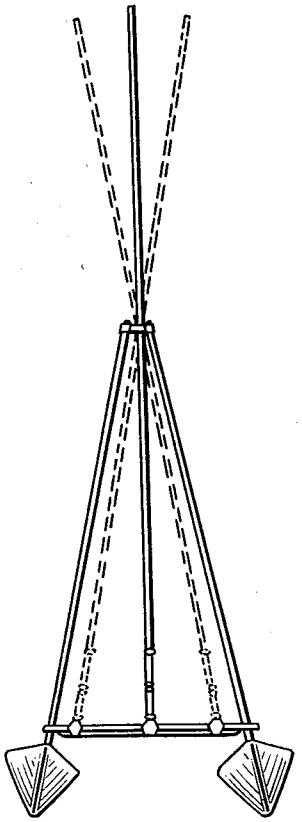
FIG. 5 is a side view of the device shown in FIG. 4.

The mast 19 is supported at its middle region at the top 23 of a support rigidly mounted on the frame members 11*a* and 11*b* and comprising two legs 24*a* and 24*b* disposed in an inverted V, while the foot 19*a* of the mast is supported on a trolley-roller or sliding element 25 capable of sliding along the front cross member 12 between the two legs 24*a* and 24*b*. The cross member acting as the rail for the trolley 25 may be a cross member other than the cross member 12, but it must in any event be located at the front of the transverse plane passing through the top 23 of the two-legged support in such a manner as to impart a certain rake to the mast 19. It is furthermore advantageous to provide means for regulating this rake, by permitting movement of legs 24*a* and 24*b* of the support over a certain length along the longitudinal members 11*a* and 11*b* (FIG. 2).

The means for articulation of the mast at the top 23 of the two-footed support must make it possible to attain maximum mobility. It may be a simple ring freely traversed by the mast 19. Or it may equally well be a mechanical articulation such as a swivel joint, but in that case, as the mast is kept at the same level, its base must be a telescoping structure (not shown) in order to enable it to extend in length whenever the foot is displaced laterally.

In order that the plane of the set of sails will be capable of assuming all the desired positions, it is advantageous to provide the point of anchorage of the tack of the boom in the form of an attachment means supported by a trolley 26 capable of sliding along a cross member 17 parallel to the cross member 12, forming a rail for the trolley 26 of the foot of the mast. In the example shown, the trolley 26 slides on the hoop 17 reinforcing the cross member 16.

The displacements of the trolleys and their immobilization in the selected position are obtained in a known manner by maneuvering ends which are parallel to the cross members and are returned to the center by guide pulleys. Advantageously, in a manner which is again known, each of the trolleys or rollers 25 and 26 secured on cross member 12 and hoop 17, respectively, is made up of a fork, rotating between the cheeks of which are two rollers rolling along the upper generatrix of the cross member in question and one roller rolling along the lower generatrix. The rollers are preferably in the form of opposing similar wheels so as to fit the cylindrical shape of the cross members, and the lower roller rotates about an immovable axis in order to enable removal of the trolley and the storing of the mast.

The apparatus according to the invention makes it possible in all cases to have the set of sails inclined toward the wind. When the catamaran is displaced on a single float, such as with one float removed from the water, the plane of the set of sails may remain near the vertical, thereby assuring better efficiency, the plane of the set of sails then being located above the active float, the one in the water (see the position shown by broken lines in FIG. 1).

In this position, the steersman, assuming the outset position, is more remote from the projection of the center of effort, which in the majority of cases makes it possible to avoid using the jib.

The fact that diagonal displacement is possible makes the jib unnecessary, and veering into the wind is accomplished without difficulty.

With a following wind, if the sail is diagonal and inclined it is out of the way of gusts and prevents turning. In the case of a cross wind and when sailing fairly close or close-hauled, having the sail inclined toward the wind relieves the strain on the boat toward the front and assures a better utilization of the air or wind.

In a more general fashion, it may be said that the opportunity for lateral displacement of the foot of the mast and the attachment of the tack of the boom makes maneuvering simpler and makes it possible to increase the speed with which maneuvers can be made, especially when tacking. The extent of possible inclination of the mast with respect to the frame makes it possible to keep the plane of the sails substantially perpendicular to the plane of the water and accordingly makes possible better utilization of the wind.

The catamaran shown is provided with inclined and symmetrical floats 10*a* and 10*b*, but the invention may be put to use for catamarans with floats of any arbitrary type.

Modifications of details of the invention may be made without departing from the scope thereof. For instance, the trolleys or rollers 25 and 26 may be different in structure from those described. Likewise, certain apparatus may be replaced by others having similar effects. The regulation of the rake of the mast, here obtained for the displacement of the feet 24*a* and 24*b*, respectively, along the longitudinal members 11*a* and 11*b* may instead be effected by displacing the cross member 12 which in that case is embodied by a tube bent in the form of a U, the arms 12*a* and 12*b* of which are mounted such that they slide but are immobilizable in the longitudinal members 11*a* and 11*b*, or else by regulating the height of the top 23 of the two-legged support, the feet 24*a* and 24*b* of which are then embodied in telescoping form. The three means of regulation, or any two of them, may coexist and be used simultaneously or independently.

It should also be noted that the act of displacing the foot of the mast toward the front completely disengages the platform 18 under the boom, and it is also possible to provide a binnacle on this platform, preferably one which can be fixed for transport.

The foregoing description of one possible application of the invention to a catamaran is given solely by way of example and not of limitation. As has already been noted at the outset, the invention may be applied to any lightweight boat whether of the trimaran, prau or single-hull type. The same is true of its application to all types of wind-powered land vehicles, whether wheeled cars, carts, sleds on runners, sleds on skis, or ice boats, the steering devices of which are displaced toward the rear. In all of these vehicles, the invention facilitates maneuvering and makes it possible to execute novel figures.

The foregoing relates to a preferred exemplary embodiment of the invention, it being understood that other embodiments and variants thereof are possible within the spirit and scope of the invention, the latter being defined by the appended claims.

what is claimed and desired to be secured by Letters Patent of the United States is:

1. A vehicle equipped with a frame including a plurality of parallel cross members including a front and back cross member, oppositely disposed parallel longitudinally extending rods joined to said plurality of cross members, a mast secured at one end to said front cross member, at least one sail fixed on said mast and attached on a boom having a trailing portion including a tack, a two-legged support means forming an inverted V, said two-legged support means mounted at a lower end thereof for slidable movement on said oppositely disposed longitudinally extending rods, said mast being supported for articulation approximately at its middle part by an upper end of said two-legged support means, and at its lower end in such a manner as to assume a longitudinal position which is regulatable in order to vary the rake of the mast, and said mast includes a foot having roller means arranged to roll along said front cross member mounted forward of said longitudinally extending rods to thereby enable said mast to move laterally along said front cross member and the trailing portion of said boom is guided along a control means.

2. A sailing vehicle as defined by claim 1, further characterized in that said tack is provided with a point of anchorage serving as a means for attachment carried by a further roller means capable of sliding on said rearwardly disposed cross member.

3. A sailing vehicle as defined by claim 1, characterized in that the front cross member for guiding the foot of the mast further includes a tube bent into the general shape of an elongated U, said elongated U having end portions which are arranged for limited movement relative to said longitudinally extending rods positioned above the frame of the vehicle.

4. A sailing vehicle as defined by claim 1, characterized in that the lower ends of the two-legged support for the mast further include a telescoping structure thereby to permit vertical displacement of the top of said two-legged support whenever the lower ends are displaced laterally.

* * * * *